United States Patent [19]

Haak et al.

[11] 3,972,267

[45] Aug. 3, 1976

[54] OVERRUNING LOAD CONTROL FOR HYDRAULIC JACKS

[75] Inventors: Willard J. Haak, Peoria; Howard A. Marsden, Pekin; James R. Sturges, Washington, all of Ill.

[73] Assignee: Caterpillar Tractor Co., Peoria, Ill.

[22] Filed: Mar. 5, 1975

[21] Appl. No.: 555,656

[52] U.S. Cl. ..... 91/445; 91/447; 91/454; 91/461; 137/495; 137/596.15; 137/596.18

[51] Int. Cl.[2] ..... F15B 11/08; F15B 13/042

[58] Field of Search ..... 91/461, 304, 454, 446, 91/445, 447; 137/495, 596.15, 596.18

[56] References Cited

UNITED STATES PATENTS 2,157,707 5/1939 Keel ..... 91/446

3,800,670 4/1974 Hufeld et al. ..... 91/454

*Primary Examiner*—Irwin C. Cohen

*Attorney, Agent, or Firm*—Phillips, Moore, Weissenberger, Lempio & Strabala

[57] ABSTRACT

An overrunning load control for a hydraulic jack includes a pair of variable orifice means in series, with the degree of metering of one of such orifices being determined by fluid pressure in the end of the hydraulic jack resisting the load. The degree of metering of the other variable orifice may be selectively chosen, through actuation of a relatively low pressure hydraulic pilot system.

7 Claims, 4 Drawing Figures

LOAD
16
42
14
10
12
40
34
36
38
62
R
L
H
F
30
28
26
146
18
24
142
32
44
48
20
46
22

270
230
286
226
268
224
229
284
222
288
240
282
280
220
232
238
266
254
10
260
252
276
278
258
247
262
281
231
242
246
256
248
264
244
236
250
227
234
LOAD
228

OVERRUNING LOAD CONTROL FOR HYDRAULIC JACKS

BACKGROUND OF THE INVENTION

This invention relates to hydraulic control systems, and more particularly, to a hydraulic control system for use as an overrunning load control system for hydraulic jacks.

Many of the directional control valves for high pressure hydraulic systems utilize poppet-type check valves for controlling the flow of fluid to and from a hydraulic jack or jacks. The poppet valves are used to more positively block fluid flow therethrough when such valves are closed, as compared with a conventional sliding spool-type valve. Generally, the speed of extension and retraction of the hydraulic jack is controlled by modulating the fluid flow from the pump to such hydraulic jacks. Although such control valves have functioned generally satisfactorily in most operating situations, one of the difficulties encountered is that of providing a fine control of an overrunning load situation such as that wherein a heavy load supported by the hydraulic jack is being lowered. In such a situation, the opening of the outlet poppet valve must be controlled for controlling the speed of the hydraulic jack.

SUMMARY OF THE INVENTION

It is accordingly an object of the present invention to provide a load control system which provides a fine control of an overrunning load situation such as the situation wherein a heavy load is supported by a hydraulic jack which is being lowered.

It is a further object of the invention to provide a load control system which, while fulfilling the above objects, is highly efficient in operation and effective in use.

Broadly stated, the invention is in a hydraulic circuit including a valve means actuatable upon application of load pressure thereto to determine a first circuit condition, and actuatable upon release of fluid pressure therefrom to determine a second circuit condition. Such invention comprises means defining first variable orifice means, and load means responsive to application of fluid pressure thereto and release of fluid pressure therefrom. Further included are means communicating the fluid pressure applied to the load means through the first variable orifice means to the valve means to actuate the valve means to determine the first circuit condition. Means are included which define second variable orifice means. Further included are means communicating the fluid pressure applied to the load means to determine the orifice size of the second variable orifice means, so that a relatively greater fluid pressure applied to the load means results in a relatively small orifice size of the second variable orifice means. Means are included for selectively reducing the orifice size of the first variable orifice means through which fluid pressure is applied to the valve means. Means are further included for allowing release of fluid pressure from the valve means through the second variable orifice means upon the selective reduction of orifice size of the first variable orifice means, to determine the second circuit condition.

BRIEF DESCRIPTION OF THE DRAWINGS

These and other objects of the invention will become apparent from a study of the following specification and drawings, in which.

DESCRIPTION OF THE PREFERRED EMBODIMENTS

Figure 1:
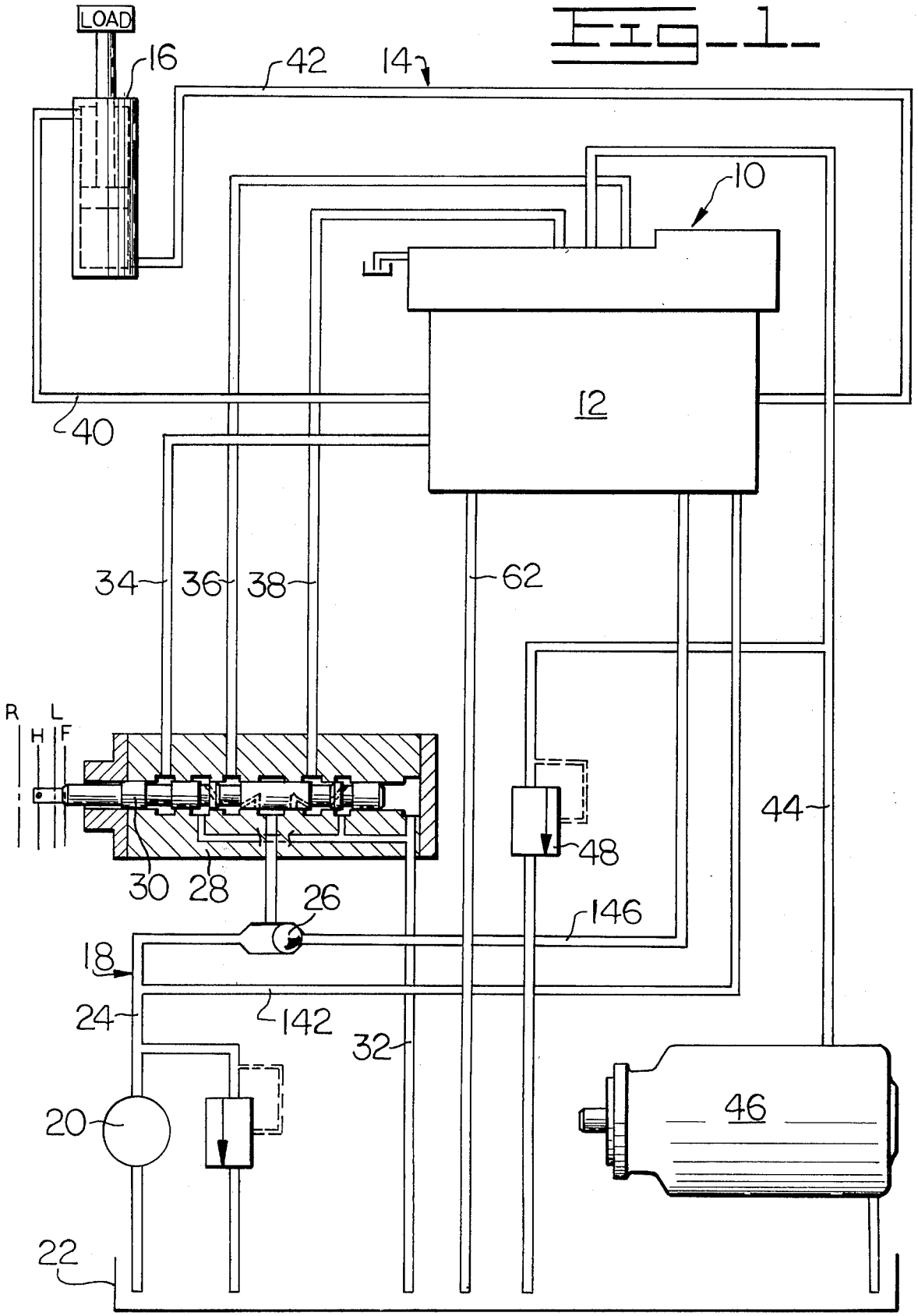
FIG. 1 illustrates a schematic of the hydraulic circuit of the present invention.
Figure 2:
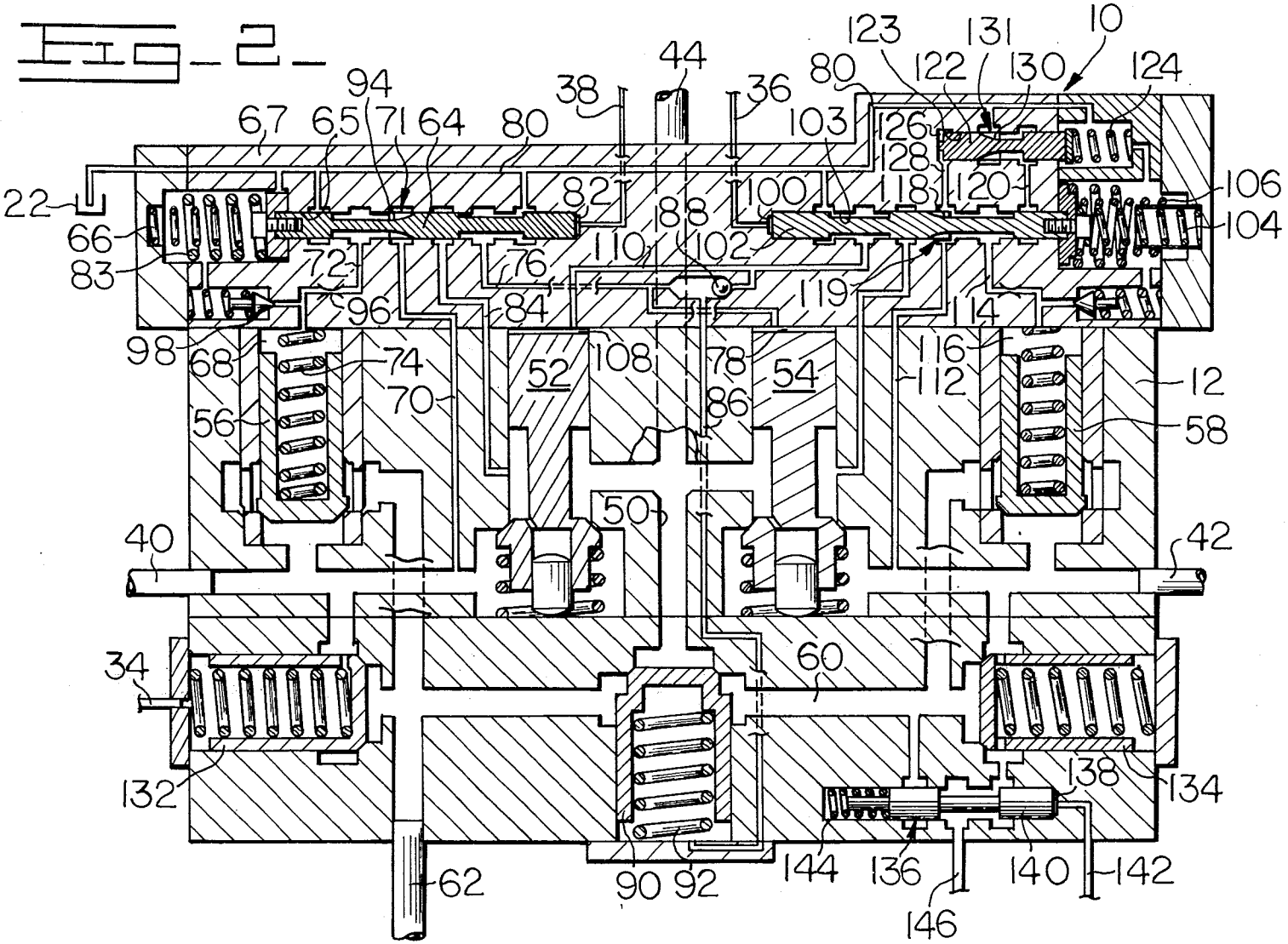
FIG. 2 is a sectional schematic illustration of the directional control valve incorporated in the system of FIG. 1.

Referring now to FIGS. 1 and 2 of the drawings, an overrunning load control is generally indicated by the reference numeral 10, incorporated as an integral part of a directional control valve 12 of a hydraulic system 14 for controlling extension and retraction of a hydraulic jack 16. The hydraulic system 14 includes a pilot circuit 18 having a pump 20 which draws fluid from a tank 22 and delivers pressurized fluid to a conduit 24 and a shuttle valve 26 to a selector valve 28. Valve spool 30 of the selector valve 28 is manually actuatable to any of four positions indicated by the letters R, H, L and F. A drain line 32 communicates the selector valve 28 with the tank while a plurality of pilot lines 34, 36 and 38 communicate the selector valve with the directional control valve 12. Selective shifting of the valve spool 30 interconnects the appropriate lines for actuating the directional control valve 12 as will be hereinafter described in greater detail.

A pair of motor conduits 40 and 42 connect the directional control valve 12 with the rod end and head end, respectively, of the hydraulic jack 16. An inlet conduit 44 communicates an implement pump 46 with the control valve 12. A relief valve 48 communicates the inlet conduit 44 to the tank 22 to relieve excessive pressure in the inlet conduit 44.

As more clearly shown in FIG. 2, the directional control valve 12 includes an inlet passage 50 in communication with the inlet conduit 44 and has a pair of pilot-actuated inlet check valves 52 and 54 which are normally spring-biased to a closed position to block communication between the inlet passage 50 and the motor conduits 40 and 42, respectively. A pair of outlet check valves 56 and 58 are provided to normally block fluid flow from the motor ports 40 and 42, respectively, to a drain passage 60 which communicates with a drain conduit 62 for returning exhausted fluid to the tank.

Extending the hydraulic jack 16 to raise the load supported thereby is accomplished by opening both the inlet check valve 54 and the outlet check valve 56 simultaneously to direct fluid from the inlet passage 50 to the motor conduit 42 and to communicate the motor conduit 40 with the drain passage 60. To lower the load, the jack 16 is retracted by opening both the inlet check valve 52 and outlet check valve 58 to direct fluid to the motor conduit 40 while communicating the motor conduit 42 with the drain passage.

Simultaneous opening and closing of the inlet check valve 54 and the outlet check valve 56 to extend the hydraulic jack 16 is controlled by a pilot actuated load control valve spool 64. Such spool 64 is reciprocably mounted in a bore 65 defined by the body 67 of the valve 12. An inner spring 66 disposed at the left end of the valve spool 64 normally urges the valve spool 64 to be positioned as shown in FIG. 2, whereby communication is established between the motor conduit 40 and the chamber 68 formed above the outlet check valve 56 through a pair of passages 70 and 72 formed in the body 67 of the valve 12. The outlet check valve 56 is normally held in the closed position by the combined force of a spring 74 and the force exerted by the hydraulic fluid directed to the chamber 68 from the motor conduit 40. Also, with the valve spool 64 in the position as shown, a passage 76 communicates a chamber 78 formed above the inlet check valve 54 with a drain passage 80 which is in communication with the tank.

Manual manipulation of the valve spool 30 of the selector valve 28 to the R position causes pilot fluid to be directed through the pilot line 38 to a chamber 82 at the right end of the valve spool 64 as viewed in FIG. 2, causing the valve spool 64 to be shifted to the left initially against the bias of inner spring 66 at a given spring rate, and subsequently against the bias of both the inner spring and an outer spring 83 at a higher spring rate, with the outer spring 83 providing modulation control of the valve spool 64. The leftward movement of the spool 64 communicates the chamber 78 above the inlet check valve 54 and the passage 76 with the inlet passage 50 through a passage 84. The fluid in passage 76 is also directed through an interconnecting passage 86 and shifts a shuttle valve 88 interposed the passage 86, permitting the fluid to be directed to the back side of a sequence valve 90. The fluid pressure acting upon the back side of the sequence valve 90 is combined with the force of a spring 92 to urge the sequence valve 90 to the closed position to block communication between the inlet passage 50 and the drain passage 60. When the fluid pressure in the inlet passage 50 and in the chamber 78 reaches a value exceeding the fluid pressure in the motor conduit 42, the inlet check valve 54 is urged downwardly to an open position to communicate the inlet passage 50 with the motor conduit 42.

Simultaneously, as the valve spool 64 is shifted leftwardly, fluid flow through the passage 70 is progressively metered by a plurality of metering slots 94 formed on the valve spool 64 which, together with the body 67, define variable orifice means 71, while the chamber 68 is communicated with the drain passage 80. The net result is a reduction in fluid pressure in the chamber 68, permitting the pressurized fluid in the motor conduit 40 to open the outlet check valve 56 against the bias of the spring 74 to communicate the motor conduit 40 with the drain passage 60. Thus, as previously described, opening both the inlet check valve 54 and the outlet check valve 56 results in the raising of the load through extension of the jack 16.

An orifice 96 is provided in the passage 72 and is utilized in combination with a spring-loaded poppet 98 which is unseated to vent the chamber 68 when the fluid pressure in the motor port 40 exceeds a pre-determined value with the outlet poppet valve 56 in the closed position. Venting the chamber 68 in this manner permits the outlet poppet valve 56 to function as a relief valve to prevent excessive pressure build-up in the motor conduit 40.

Manual manipulation of the valve spool 30 of the selector valve 28 to the L position directs pilot pressure through the lines 36 to a chamber 100 at the left end of a pilot actuated load control valve spool 102. The valve spool 102 is reciprocable in a bore 103 defined by the body 67. The fluid acting thereon shifts the valve spool 102 to the right initially against the bias of an inner spring 104 at one spring rate, and subsequently against the bias of both the inner spring and an intermediate spring 106 at a higher spring rate to control the opening of the inlet check valve 52 and the outlet check valve 58. As the valve spool 102 is moved to the right, communication is established between the inlet passage 50 and a chamber 108 above th inlet check valve 52 through a passage 110 causing the inlet check valve 52 to open. The passage 110 is also in communication with the passage 86 such that the shuttle valve 88 is shifted to permit fluid flow therethrough to the sequence valve 90. Also, as the valve spool 102 is moved to the right, communication through a pair of passages 112 and 114 extending between the motor conduit and the chamber 116 formed above the outlet check valve 58 is progressively blocked by a plurality of metering slots 118 formed in the valve spool 102. Communication is also established between the passage 114 and a passage 120. The metering slots 118 and body 67 together define variable orifice means 119 with the size of the orifice being dependent upon the travel distance of the spool 102, and thus, the pressure of the pilot fluid directed to the chamber 100 from the selector valve 28. The springs 104, 106 resist movement of the spool to reduce the orifice size, i.e., such springs tend to move the spool 102 in a direction wherein the orifice size of the orifices means 119 is at its greatest.

The overrunning load control 10 includes a valve spool 122 reciprocable within a bore 123 defined by the body 67, such valve spool 122 being disposed in series with the valve spool 102. Such valve spool 122 controls the fluid flow through a passage 120 when the valve spool 102 is shifted to the right for venting the chamber 116 to open the outlet check valve 58. The valve spool 122 is resiliently urged to the left by a spring 124 to establish communication between the passage 120 and the drain passage 80. A chamber 126 is formed at the opposite end of the valve spool 122 and is in communication with the motor conduit 42 through a passage 128 and the passage 112, such that the spool 122 is moved to the right against the resiliency of the spring in proportion to the pressure level in the motor port 42. A plurality of metering slots 130 are formed in the valve spool 122, and, with the body 67, form variable orifice means 131 which restrict or meter the flow of fluid through the passage 120 to the drain passage 80 in proportion to the fluid pressure in the motor conduit 42. Movement of the spool 122 to reduce the orifice size of the variable orifice means 131 is resisted by the spring 124. Thus, the pressure balance across the outlet check valve 58 may be precisely controlled by manually modulating the valve spool 102 for metering the fluid flow through the passage 120 and the metering slots 130 in proportion to the load supported by the hydraulic jack 16.

For example, when the hydraulic jack 16 is supporting a relatively light load, the orifice size of the orifice means 131 will provide the maximum orifice opening which will have little effect on the opening of the outlet check valve 58. Under this condition, modulation of the opening of the outlet check valve 58 is accomplished by modulation of the selector valve spool 30 to control the rightward movement of the valve spool 102 and thus the orifice area afforded by the orifice means 119. However, if the hydraulic jack 16 is supporting a heavy load, the area of the orifice means 131 is greatly reduced, offering a greater resistence to flow through the passage 120. The combined metering of the orifice means 119 and orifice means 131 provides a fine control over the pressure balance across the outlet check valve 58, and thus the opening of the check valve 58. Preferably, the combined metering afforded by both orifice means 119 and 131 permits the outlet check valve 58 to open sufficiently for the hydraulic jack 16 to retract at a velocity slightly greater than that which can be created by pump flow into the rod end of the hydraulic jack 16.

A pair of make-up valves 132 and 134 are integrally incorporated within the directional control valve 12 and permit make-up fluid to be drawn into the respective motor conduits 40 and 42 when the fluid pressure value in the drain passage 60 is greater than the fluid pressure value in the respective motor conduit.

A dead engine valve 136 is also incorporated in the directional control valve 12 and includes a control chamber 138 disposed at one end of a valve spool 140. A line 142 communicates the chamber with the conduit 24 such that the fluid pressure generated by the pilot pump 20 moves the valve spool 140 against the bias of a spring 144 to establish communication between the drain passage 60 and the shuttle valve 26 through a line 146. Under this condition the fluid pressure in the drain passage 60 is substantially lower than the pump pressure in the conduit 24 and thus the shuttle valve 26 remains in the position shown so that the pump 20 is in communication with the selector valve 28. However, when the pump 20 is inactive, such as when the drive motor or engine is stopped, the spring 144 urges the valve spool 140 to the right to establish communication between the motor conduit 42 and the shuttle valve 26. If the hydraulic jack 16 is extended and supporting a load, sufficient fluid pressure will exist in the motor conduit 42 to shift the shuttle valve 26 to establish communication with the selector valve 28. Such fluid may be directed by the selector valve 28 to the chamber 100 to shift the valve spool 102 and vent the chamber 116 above the outlet check valve 58 for lowering the hydraulic jack 16.

Figure 3:
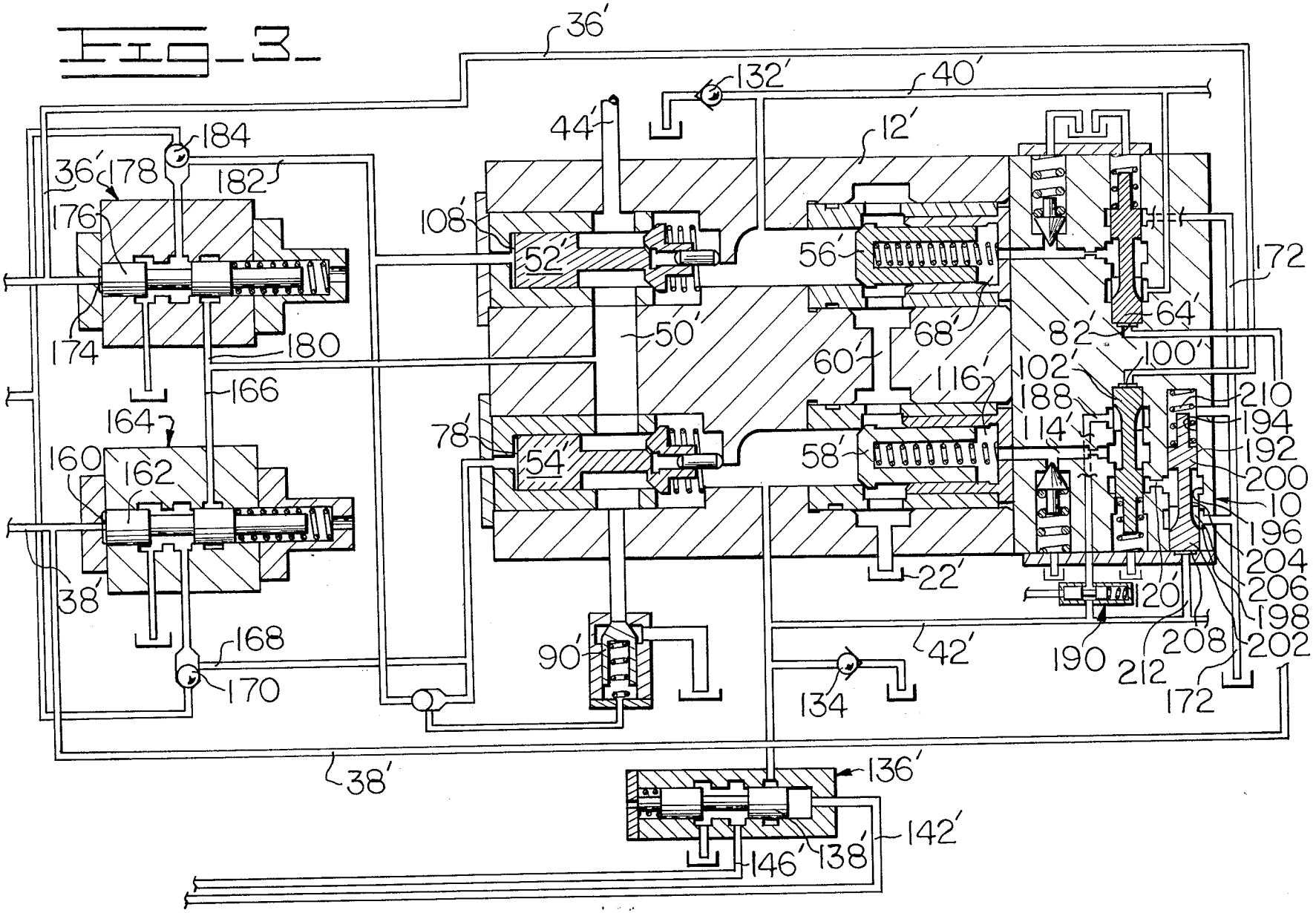
FIG. 3 is a sectional view of an alternate embodiment of the directional control valve.

FIG. 3 discloses an alternate embodiment of the overrunning load control 10 integrally disposed within a directional control valve 12' which is similar to that disclosed in FIG. 19 of U.S. Pat. No. 3,575,000. With such valve, fluid from the implement pump is directed through the inlet conduit 44' into the inlet passage 50'. With the directional control valve in the neutral or hold position, the fluid unseats the sequence valve 90' and is returned to the tank. Shifting the pilot selector valve, of the type disclosed in FIG. 3 of the above patent, to the raise position results in a pilot signal being directed through the pilot line 38' simultaneously to a chamber 160 behind a valve spool 162 of a second stage valve 164 and to the chamber 82' behind the load control valve spool 64'. The fluid in chamber 160 causes the valve spool 162 to shift to the right to communicate inlet passage 50' with the chamber 78' adjacent to the inlet check valve 54' through a pair of lines 166 and 168 and a shuttle valve 170. The fluid in the chamber 78' opens the inlet check valve and communicates the inlet passage with motor conduit 42' connected to the head end of hydraulic jack 16.

The pilot fluid in the chamber 82' shifts valve spool 64' to establish communication between the chamber 68' behind the outlet check valve 56' and a drain conduit 172. This vents chamber 68' so that fluid pressure in motor conduit 40' acting on the face of outlet check valve 56' opens the outlet check valve to communicate the motor conduit with the drain passage 60' connected to tank 22'. Thus, with inlet passage 50' connected to the motor conduit 42' and the motor conduit 40' communicating with the drain passage 60', the hydraulic jack 16 extends to raise the load.

Shifting the selector control valve to the lower position results in a pilot signal being directed through the pilot line 36' simultaneously to a chamber 174 behind a valve spool 176 of a second stage valve 178 and into the chamber 100' behind the load control valve spool 102'. The fluid in chamber 174 causes valve spool 176 to shift to the right to communicate the inlet passage 50' with the chamber 108' adjacent to the inlet check valve 52' through a pair of lines 180 and 182 and a shuttle valve 184. The fluid in chamber 108' opens the inlet check valve and communicates inlet passage 50' with the motor conduit 40'. The pilot fluid in chamber 100' shifts valve spool 102' downwardly and communicates the chamber 116' behind outlet check valve 58' with the drain conduit 172 through passages 114' and 120' and the overrunning load control 10 as will hereinafter be described in greater detail. The downward movement of valve spool 102' starts to throttle or meter communication between a passage 188 connected to the motor conduit 42' through a normally open float control valve 190 and passage 114' leading to chamber 116'. The net result of the downward movement of the valve spool 102' is the progressive venting of chamber 116' to the tank permitting fluid pressure in conduit 42' to open the outlet check valve 58' resulting in retraction of the hydraulic jack and lowering of the load.

The overrunning load control 10 includes a valve spool 192 slidably disposed in a bore 194 having a pair of axially spaced annular grooves 196 and 198 formed therein. The passage 120' opens into the annular groove 196 while the annular groove 198 is in communication with the drain passage 172. The valve spool has a pair of spaced land portions 200 and 202 disposed on opposite sides of an annular groove 204 and is provided with a plurality of metering slots 206 formed in the land 202 and opening into the annular groove. A chamber 208 is formed at the lower end of the valve spool which is resiliently biased toward the chamber by a spring 210. The chamber is in communication with the motor conduit 42' through a conduit 212.

When the hydraulic jack is supporting a heavy load, a relatively high fluid pressure value exists in the motor conduit 42' and thus the conduit 212 and chamber 208. The pressurized fluid moves the valve spool 192 upward against the bias of the spring 210 with the amount of movement dependent upon the pressure value in the motor conduit. When the selector valve is shifted to lower the hydraulic jack, the fluid passing through passage 120' into the annular groove 196 is metered by the metering slots 206 with the degree of metering directly proportional to the fluid pressure in motor conduit 42'. For example, if the jack is lightly loaded, the throttling slots offer very little resistance to fluid flow therethrough and the lowering speed of the jack is controlled by metering the fluid through the metering slots of the load control valve spool 102'. However, if the jack is supporting a heavy load, the flow path through the metering slots 206 is greatly reduced with the metering slots metering the flow of fluid therethrough. Thus, the combined metering of both the load control valve spool 102' and the valve spool 192 of the overrunning load control 10 provides infinite modulation and precise control of the retraction speed of the hydraulic jack for controlled lowering of the load supported thereby.

Figure 4:
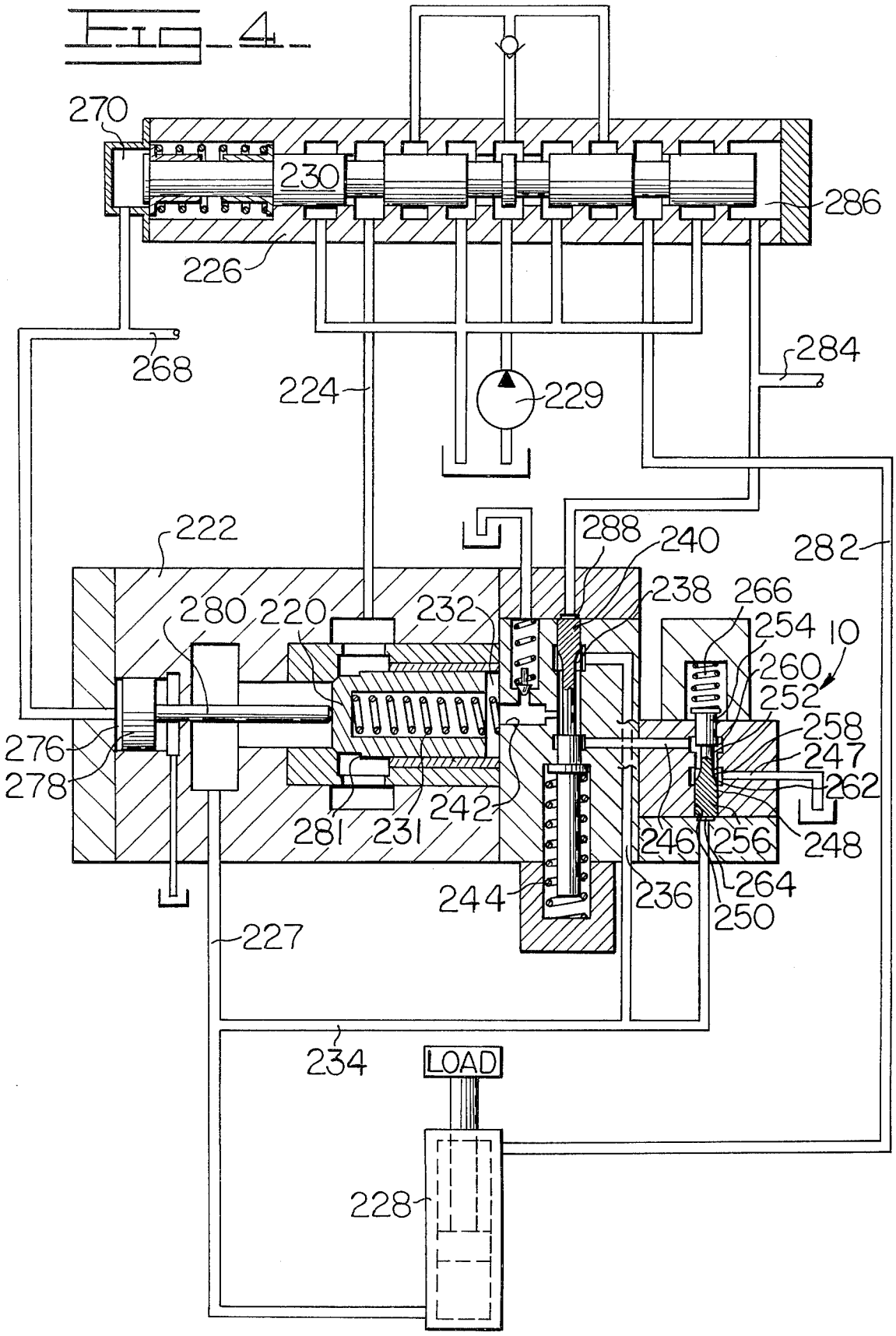
FIG. 4 is a sectional view of yet another embodiment of the directional control valve.

A second alternate embodiment of the overrunning load control 10 is shown in FIG. 4 in combination with a poppet-type check valve 220, both of which are disposed in a valve body 222. A conduit 224 connects a conventional pilot operated spool control valve 226 to the valve body while a motor conduit 227 connects the valve body to the head end of a hydraulic jack 228. When the control valve 226 is in the neutral or hold position shown, fluid flow from the implement pump 229 is blocked by the valve spool 230 while fluid flow through the conduits 224 and 227 is blocked by the check valve. The check valve is held in the closed position by the combined force of a spring 231 contained within a chamber 232 formed behind the check valve and the fluid pressure in the chamber acting on the back side of the check valve. Such fluid pressure is generated in the motor conduit by the load supported by the hydraulic jack and is transmitted to the chamber through a branch conduit 234 connected to the motor conduit, a passage 236 formed in the valve body, a plurality of metering slots 238 formed in a load control valve spool 240 and an orificed passage 242. Due to differential in areas, the force exerted on the back side of the check valve by the fluid in the chamber is greater than the force exerted on the face of the check valve by the fluid in the motor conduit 227. The valve spool 240 is resiliently urged by a spring 244 to the position shown for blocking communication from the passages 236 and 242 to a passage 246 which is normally open to the tank through the overrunning load control valve 10 and a drain passage 247.

The overrunning load control valve 10 includes a valve spool 248 slidably disposed in a bore 250 formed in the valve body 222. A reduced diameter portion 252 is formed on the valve spool between a pair of lands 254 and 256. A plurality of metering slots 258 are formed in the land 256 for metering fluid flow between a pair of annular grooves 260 and 262 formed in the bore 250. The passage 246 is connected to the groove 260 while the groove 262 is connected to the drain passage 247. A chamber 264 is formed at the lower end of the valve spool and is connected to the branch conduit 234. Thus, fluid pressure in the motor conduit 227 is transmitted to the chamber 264, urging the valve spool upwardly against the bias of a spring 266. The amount of upward movement and thus the amount of metering provided by the metering slots is dependent upon the fluid pressure in the motor conduit.

To extend the hydraulic jack 228 to raise the load, pilot pressure from a selector valve (not shown) is directed through a pilot line 268 into an actuating chamber 270 of the control valve 226 for shifting the spool 230 to direct fluid from the implement pump 229 through the conduit 224 to the valve body 222. The pilot fluid in the pilot line is also directed to a chamber 276 behind a piston 278 slidably disposed in the valve body 222. A stem 280 of the piston is adapted for engagement with the check valve 220 with the force exerted thereon by the piston being slightly greater than the force of the spring 231. However, before the check valve can be unseated, sufficient fluid pressure must be built up in the conduit 224 by the pump and acting on an annular shoulder 281 to overcome the force exerted on the back side of the check valve by the fluid in the chamber. This insures that the fluid pressure in the conduit 224 is substantially equal to or greater than the fluid pressure in the conduit 227 to prevent any downward movement of the load when the check valve opens as would occur if the pressure in the conduit 224 were lower than the pressure in the motor conduit 227. The fluid exhausted from the rod end of the hydraulic jack is directed through a conduit 282 and the control valve 226 to the tank.

To retract the jack 228 for lowering the load, a pilot signal is directed from the selector valve through a pilot line 284 into an actuating chamber 286 to shift the valve spool 230 to direct pressurized fluid through the conduit 282. The pilot line 284 is also connected to a chamber 288 behind the load control valve spool 240 urging the spool downwardly. As the spool is moved downwardly, communication is established between the chamber 232 and the tank through the passages 242 and 246, overrunning load control valve 10 and the passage 247. Also, communication through the passage 236 is progressively blocked by the metering slots 238 with the amount of restriction afforded by the metering slots being dependent upon the travel distance of the valve spool and thus the pressure of the pilot fluid directed to the chamber 288. The result of the downward movement of the valve spool is the progressive venting of the chamber 232 to the tank permitting fluid pressure in the conduit 227 to open the check valve 220 resulting in retraction of the hydraulic jack and lowering of the load.

When the hydraulic jack 228 is being lowered, the fluid passing through the passage 246 into the annular groove 260 is metered by the metering slots 258 on the valve spool 248 with the degree of metering directly proportional to the fluid pressure in the motor conduit 227. Thus, as with the previous embodiments, the combined metering of both the load control valve spool 240 and the valve spool 248 provides precise control over the retraction speeds of the hydraulic jack and prevents overrunning thereof.

What is claimed is:

1. In a hydraulic circuit including valve means actuatable upon application of fluid pressure thereto to determine a first circuit condition, and actuatable upon release of fluid pressure therefrom to determine a second circuit condition:

means defining first variable orifice means and outlet orifice means;

motor means responsive to application of fluid pressure thereto and release of fluid pressure therefrom;

means for supplying fluid pressure to said motor means means communicating the fluid pressure applied to the motor means through the first variable orifice means to the valve means to actuate the valve means to determine the first circuit condition;

pressure responsive means defining second variable orifice means;

means communicating the fluid pressure applied to the motor means to determine the orifice size of the second variable orifice means, so that a relatively greater fluid pressure applied to the motor means results in a change in the orifice size of the second variable orifice means;

means for selectively reducing the orifice size of the first variable orifice means through which fluid pressure is applied to the valve means and opening said outlet orifice means; and means for allowing release of fluid pressure from the valve means via said outlet orifice means and through the second variable orifice means upon the selective reduction of orifice size of the first variable orifice means, to determine the second circuit condition.

2. The system of claim 1, wherein the means defining the first variable orifice means comprise a body defining a bore, and a spool reciprocable within a bore, and resilient means resisting movement of the spool to selectively reduce the orifice size of the first variable orifice means.

3. The system of claim 2, wherein the resilient means comprise means for resisting initial movement of the spool to selectively reduce the orifice size of the first variable orifice means at a first spring rate, and for resisting subsequent movement of the spool to selectively reduce the orifice size of the first variable orifice means at a second spring rate higher than said first spring rate.

4. The system of claim 3, wherein the means defining the second variable orifice means comprise a body defining a bore, and a second spool reciprocable therein, and resilient means for resisting movement of the second spool to change the orifice size of the second variable orifice means, the fluid pressure applied to the motor means being communicated to the second spool to move the second spool against the resilient means associated therewith.

5. The system of claim 4 and pilot means for selectively applying fluid pressure to the first-mentioned spool to move the first-mentioned spool against the resilience of the resilient means associated therewith.

6. The system of claim 2 and pilot means for selectively applying fluid pressure to the spool to move said spool against the resilience of the resilient means associated therewith.

7. The system of claim 1 and comprising means on said second variable orifice means for providing that the relatively greater fluid pressure applied to the motor means results in a relatively smaller orifice size of the second variable orifice means.

* * * * *